US011608246B2

(12) United States Patent
Manes

(10) Patent No.: US 11,608,246 B2
(45) Date of Patent: Mar. 21, 2023

(54) CONVEYANCE SYSTEM WITH LOADING FACTOR DETECTION

(71) Applicant: Otis Elevator Company, Farmington, CT (US)

(72) Inventor: Enrico Manes, Feeding Hills, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 563 days.

(21) Appl. No.: 16/713,757

(22) Filed: Dec. 13, 2019

(65) Prior Publication Data

US 2020/0189878 A1 Jun. 18, 2020

Related U.S. Application Data

(60) Provisional application No. 62/779,524, filed on Dec. 14, 2018.

(51) Int. Cl.
*B66B 1/34* (2006.01)
*B66B 5/00* (2006.01)

(52) U.S. Cl.
CPC ..... *B66B 1/3476* (2013.01); *B66B 1/3492* (2013.01); *B66B 5/0012* (2013.01)

(58) Field of Classification Search
CPC ..... B66B 1/3446; B66B 5/0018; B66B 3/00; B66B 5/0012; B66B 1/34; B66B 1/3453; B66B 1/3476; B66B 5/02; B66B 5/0037; B66B 1/3415; B66B 5/0006; B66B 2201/23
See application file for complete search history.

(56) References Cited

U.S. PATENT DOCUMENTS

| | | | |
|---|---|---|---|
| 9,185,528 | B2 | 11/2015 | Schwartz et al. |
| 9,725,279 | B2 | 8/2017 | Armistead |
| 9,756,387 | B2 | 9/2017 | Rowe |
| 9,972,177 | B1 | 5/2018 | Kashyap et al. |
| 2006/0164240 | A1 | 7/2006 | Patchell |
| 2013/0162459 | A1 | 6/2013 | Aharony et al. |
| 2015/0344265 | A1 | 12/2015 | Hakonen et al. |
| 2016/0297642 | A1 | 10/2016 | Finn et al. |
| 2016/0315682 | A1 | 10/2016 | Liu et al. |

(Continued)

FOREIGN PATENT DOCUMENTS

| | | | |
|---|---|---|---|
| CN | 202785134 | U | 3/2013 |
| CN | 104021599 | A | 9/2014 |

(Continued)

OTHER PUBLICATIONS

European Search Report for Application No. 19215679.2; dated May 12, 2020; 7 Pages.

(Continued)

*Primary Examiner* — Marlon T Fletcher
(74) *Attorney, Agent, or Firm* — Cantor Colburn LLP

(57) ABSTRACT

A conveyance system includes a transmitter configured to generate a signal; a receiver configured to receive the signal; the transmitter and receiver located so that the signal passes through a passenger area of the conveyance system; a controller configured to receive a signal strength of the signal received at the receiver; the controller configured to determine a loading factor in the passenger area in response to the signal received at the receiver.

12 Claims, 6 Drawing Sheets

(56) References Cited

U.S. PATENT DOCUMENTS

| | | | | |
|---|---|---|---|---|
| 2017/0233220 | A1 | 8/2017 | Scoville et al. | |
| 2019/0373530 | A1 * | 12/2019 | Witczak | H04W 40/20 |

FOREIGN PATENT DOCUMENTS

| | | | | | |
|---|---|---|---|---|---|
| CN | 104340803 | A | | 2/2015 | |
| CN | 106379788 | A | | 2/2017 | |
| CN | 107527504 | A | | 12/2017 | |
| CN | 108349706 | A | * | 7/2018 | B66B 1/3492 |
| CN | 110040589 | A | * | 7/2019 | B66B 1/28 |
| EP | 3666705 | A1 | * | 6/2020 | B66B 1/3476 |
| GB | 2389415 | A | | 12/2003 | |
| KR | 20180003711 | A | * | 6/2016 | |
| WO | WO-2014000792 | A1 | * | 1/2014 | B66B 1/3476 |

OTHER PUBLICATIONS

Choi et al. "People Counting Based on an IR-UWB Radar Sensor", IEEE Sensors Journal, 2017, Abstract Only, 4 Pages.

Depatla, Saandeep, "Crowd Counting Through Walls Using WiFi", available at: https://www.ece.ucsb.edu/~ymostofi/papers/Percom18_DepatlaMostofi.pdf, accessed Dec. 11, 2019, 10 pages.

Fernandez, Sonia, "The Current, Counting People with WiFi", The UCSB Current, Jun. 8, 2015, 3 pages.

Xi et al. "Electronic Frog Eye: Counting Crowd Using WiFi", International Conference on Computer Communications, 2014, Abstract Only, 1 Page.

Zou, et al. "FreeCount: Device-Free Crowd Counting with Commodity WiFi", Published in: Globecom—IEEE Global Communications Conference, Dec. 4-8, 2017, Abstract Only, 4 Pages.

* cited by examiner

| Loading Factor | Transmission strength | Reception strength | Signal Loss |
|---|---|---|---|
| 0 | 100 | 90 | 10 |
| 1 | 100 | 85 | 15 |
| 2 | 100 | 80 | 20 |
| 3 | 100 | 70 | 30 |
| . | | | |
| . | | | |
| N | | | |

FIG. 4

CONVEYANCE SYSTEM WITH LOADING FACTOR DETECTION

CROSS-REFERENCE TO RELATED APPLICATIONS

This application claims the benefit of U.S. provisional patent application Ser. No. 62/779,524, filed Dec. 14, 2018, the entire contents of which are incorporated herein by reference.

BACKGROUND

The embodiments herein relate to conveyance systems, and more particularly to a conveyance system using wireless signals to detect a loading factor.

Conveyance systems, such as, for example, elevator systems, escalator systems, and moving walkways carry passengers, cargo, pets, etc., from one location to another. It may be useful to detect a loading factor for the conveyance system, such as the number of passengers, cargo, luggage, pets, etc. For example, in an elevator system, detecting the loading factor in an elevator car can be useful in controlling travel of the elevator car. In elevator systems where users place destination calls, detecting the loading factor in an elevator car can identify situations where a single passenger enters multiple destination calls.

SUMMARY

According to an embodiment, a conveyance system includes a transmitter configured to generate a signal; a receiver configured to receive the signal; the transmitter and receiver located so that the signal passes through a passenger area of the conveyance system; a controller configured to receive a signal strength of the signal received at the receiver; the controller configured to determine a loading factor in the passenger area in response to the signal received at the receiver.

In addition to one or more of the features described herein, or as an alternative, further embodiments of the system may include wherein the controller is configured to determine the loading factor in the passenger area in response to the signal strength of the signal received at the receiver.

In addition to one or more of the features described herein, or as an alternative, further embodiments of the system may include wherein the controller stores a correlation of a loading factor in the passenger area to the signal strength of the signal received at the receiver.

In addition to one or more of the features described herein, or as an alternative, further embodiments of the system may include wherein the controller is configured to determine the loading factor in the passenger area in response to signal loss of the signal from the transmitter to the receiver.

In addition to one or more of the features described herein, or as an alternative, further embodiments of the system may include wherein the controller stores a correlation of a loading factor in the passenger area to signal loss of the signal from the transmitter to the receiver.

In addition to one or more of the features described herein, or as an alternative, further embodiments of the system may include wherein the passenger area comprises a moving portion of the conveyance system.

In addition to one or more of the features described herein, or as an alternative, further embodiments of the system may include wherein the conveyance system comprises an elevator system and the passenger area comprises an elevator car.

In addition to one or more of the features described herein, or as an alternative, further embodiments of the system may include wherein the loading factor corresponds to one or more of passengers, cargo, luggage and pets in the passenger area.

According to another embodiment a method of operating a conveyance system includes transmitting a signal through a passenger area of the conveyance system; receiving a signal strength of the signal after passing through the passenger area of the conveyance system; determining a loading factor in the passenger area in response to the signal after passing through the passenger area of the conveyance system.

In addition to one or more of the features described herein, or as an alternative, further embodiments of the method may include wherein the determining is in response to the signal strength of the signal after passing through the passenger area of the conveyance system.

In addition to one or more of the features described herein, or as an alternative, further embodiments of the method may include correlating of a loading factor in the passenger area to signal strength of the signal after passing through the passenger area of the conveyance system.

In addition to one or more of the features described herein, or as an alternative, further embodiments of the method may include determining is in response to signal loss of the signal after passing through the passenger area of the conveyance system.

In addition to one or more of the features described herein, or as an alternative, further embodiments of the method may include correlating a loading factor in the passenger area to signal loss of the signal after passing through the passenger area of the conveyance system.

In addition to one or more of the features described herein, or as an alternative, further embodiments of the method may include wherein the passenger area comprises a moving portion of the conveyance system.

In addition to one or more of the features described herein, or as an alternative, further embodiments of the method may include wherein the conveyance system comprises an elevator system and the passenger area comprises an elevator car.

In addition to one or more of the features described herein, or as an alternative, further embodiments of the method may wherein the loading factor corresponds to one or more of passengers, cargo, luggage and pets in the passenger area.

Technical effects of embodiments of the present disclosure include the ability to identify a loading factor in a passenger area of a conveyance system and control the conveyance system accordingly.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

FIG. 4 depicts correlating a received signal to a loading factor in an example embodiment;

DETAILED DESCRIPTION

Figure 1:
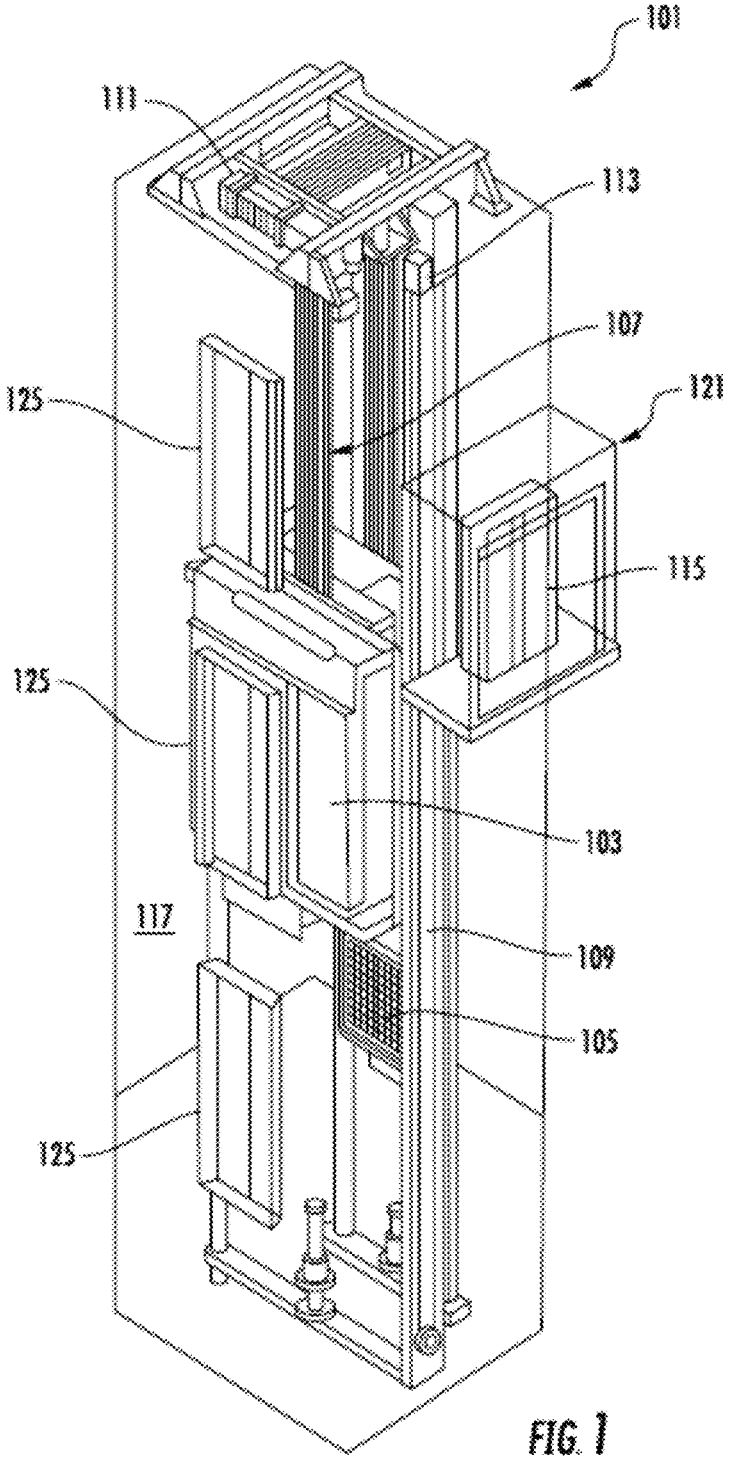
FIG. 1 depicts an elevator system in an example embodiment.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator hoistway 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator hoistway 117, such as on a support or guide rail, and may be configured to provide position signals related to a position of the elevator car 103 within the elevator hoistway 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator hoistway 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator hoistway 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator hoistway 117.

Although shown and described with a roping system including tension member 107, elevator systems that employ other methods and mechanisms of moving an elevator car within an elevator hoistway may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

In other embodiments, the system comprises a conveyance system that moves passengers between floors and/or along a single floor. Such conveyance systems may include escalators, people movers, moving walkways, etc. Accordingly, embodiments described herein are not limited to elevator systems, such as that shown in FIG. 1.

Figure 2:
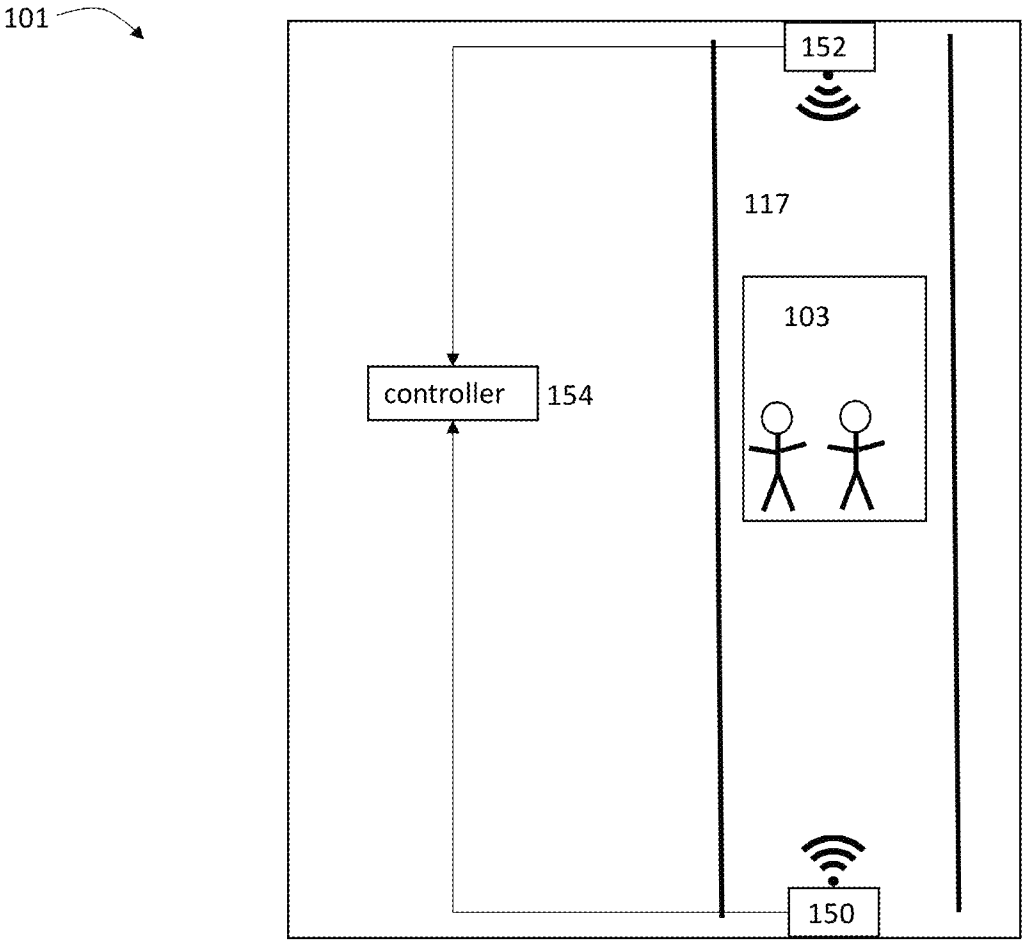
FIG. 2 depicts an elevator system with loading factor detection in an example embodiment.

FIG. 2 depicts an elevator system 101 with a passenger detection system in an example embodiment. The elevator system 101 may include the elements of FIG. 1, many of which are not shown for clarity of illustration. The elevator system 101 includes a transmitter 150 positioned at a first location in the elevator system 101. The transmitter 150 generates a wireless signal, such as a radio signal in accordance with the IEEE 802.11xx protocol. It is understood that other signal formats may be used for the signal transmitted by transmitter 150. A receiver 152 is positioned at a second location in the elevator system 101. The receiver 152 receives the wireless signal from the transmitter 150. The transmitter 150 and the receiver 152 are located so that at least a portion of the signal from the transmitter 150 passes through a passenger area prior to reception at the receiver 152. In FIG. 2 the transmitter 150 is located at the bottom of the hoistway 117 and the receiver 152 is located at the top of the hoistway 117. It is understood that the transmitter 150 and/or the receiver 152 may be located at different locations, such as on the top or the bottom of the elevator car 103. The transmitter 150 and receiver 152 may be part of an existing wireless network within the building containing the elevator system 101. For example, the transmitter 150 and receiver 152 may be existing wireless access points in the building, which are used to provide wireless network access to individuals, communicate information to and from the elevator car 103, send infotainment to the elevator car 103, etc. The transmitter 150 and the receiver 152 are in communication with a controller 154, using known communication techniques (e.g., wired and/or wireless networking). The controller 154 may be the same controller 115 that controls movement of the elevator car 103 or a different controller in communication with controller 115. The controller 154 may be implemented using a processor-based device (e.g., computer, server, distributed computing network, etc.) having known elements (processor, memory, communication device, etc.). The controller 154 may be local, remote, a dispatching controller, group controller, etc.

Figure 3:
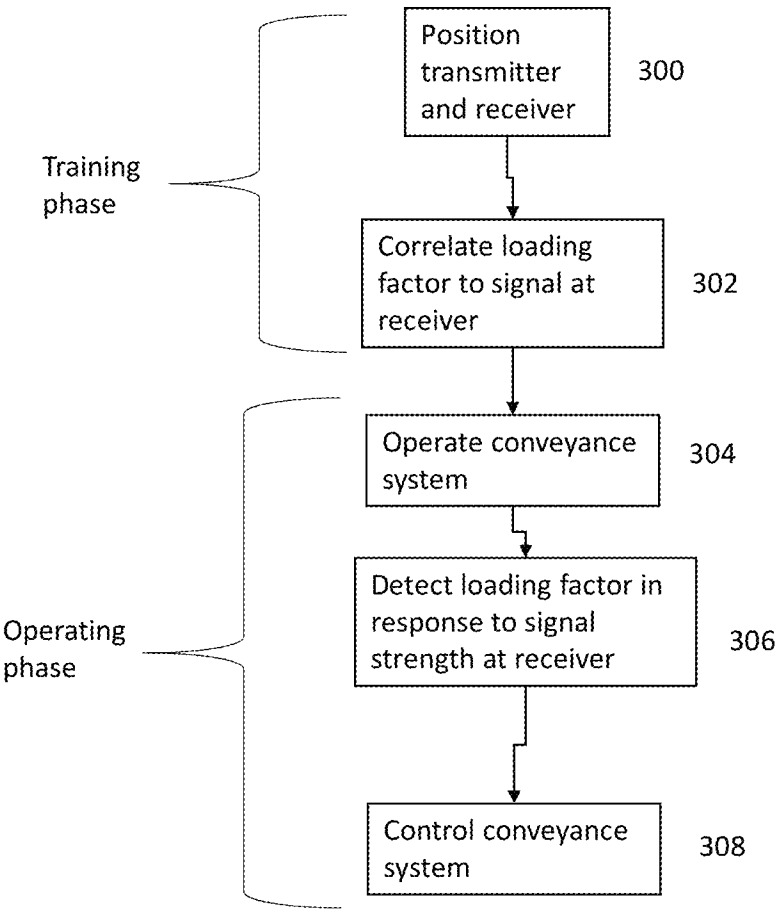
FIG. 3 depicts a process for loading factor detection in an example embodiment.

FIG. 3 depicts a process for loading factor detection in an example embodiment. The process is described with reference to an elevator system, but may be employed with any conveyance system. The process includes a training phase and an operating phase. The training phase begins at 300 where the transmitter 150 and the receiver 152 are placed in the conveyance system. As noted above, the transmitter 150 and the receiver 152 are positioned so that at least a portion of the signal from the transmitter 150 to the receiver 152 passes through a passenger area of the conveyance system. At 302, a correlation between signal at the receiver 152 and the loading factor is generated. As noted above, the loading factor indicates general occupied volume of the passenger area, and may indicated presence of passengers, luggage, cargo, pets, etc. This may be performed by operating the conveyance system with varying volumes (e.g., passengers, luggage, cargo, pets, etc.) and recording the affect on the signal received at the receiver 152. FIG. 4 depicts a correlation of the received signal at the receiver 152 to a loading factor in an example embodiment. For example, with no passengers, luggage, cargo, pets, etc. in the elevator car 103, and a transmission signal strength of 100, the receiver 152 receives the signal from the transmitter 150 having a signal strength of 90. The signal strength may be defined using known measures, such as mW, RSSI, dBm, etc., and the values in FIG. 4 are examples. This represents a signal loss of 10. The training phase may continue by adding objects (including passengers) to the elevator car 103 and measuring the received signal strength at the receiver 152 and the signal loss. The signal loss is due to the objects absorbing a given amount of radiation in the frequency band of the signal. The signal loss value may be useful in detecting the loading factor, as the transmission strength of the signal from the transmitter 150 may vary with time, temperature, etc.

Referring back to FIG. 3, once the training phase is complete, the operating phase begins with normal operation of the conveyance system at 304. As the conveyance system operates, the transmitter 150 continuously transmits the signal to the receiver 152. The transmitter 150 may provide the transmitted signal strength to the controller 154. The signal strength of the signal received at the receiver 152 is also provided to the controller 154. At 306, the controller 154 uses the correlation between the signal received at the receiver 152 to the loading factor to determine the loading factor in the car 103. The controller 154 may use the signal strength of the signal received at the receiver 152 or the signal loss from the transmitter 150 to the receiver 152 to detect the loading factor in the elevator car 103.

Once the loading factor in the elevator car 103 is detected, the elevator system 101 may be controlled as shown at 308. For example, if the loading factor in the elevator car 103 is high, then that elevator car 103 may not be assigned to any further elevator calls. If the elevator car 103 is empty, then that elevator car 103 may be assigned to the lobby to pick up a large group of passengers. If the elevator car 103 is full, then that elevator car 103 may prevented from stopping for additional passengers. The elevator system can also detect dummy calls, in which a plurality of elevator destination calls have been made, but only a single passenger is in the elevator car 103. It is understood that a variety of other operations may be performed in response to the loading factor detected.

Figure 5:
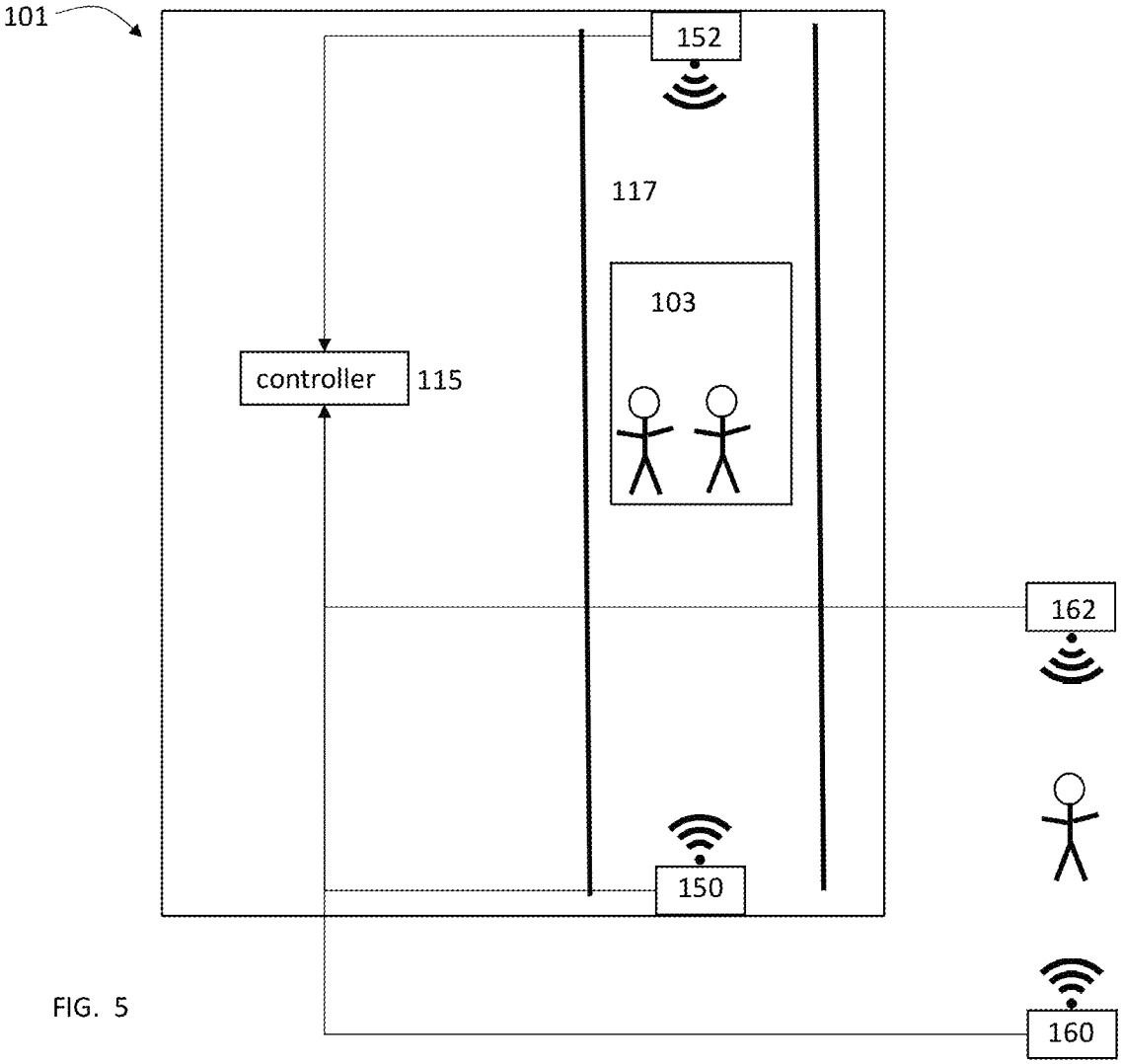
FIG. 5 depicts an elevator system with loading factor detection in an example embodiment.

FIG. 5 depicts an elevator system with loading factor detection in another example embodiment. In the example in FIG. 5, a transmitter 160 and receiver 162 are located in a passenger waiting area, such as a lobby or a landing. The process of FIG. 3 may be performed with respect to the transmitter 160 and the receiver 162 in order to detect a loading factor in the passenger area of the conveyance system, including passengers, luggage, cargo, pets, etc. In the example of FIG. 5, the controller 154 may detect a large number of people waiting in a lobby area and assign elevator cars 103 to the lobby even before passengers begin making elevator calls.

Figure 6:
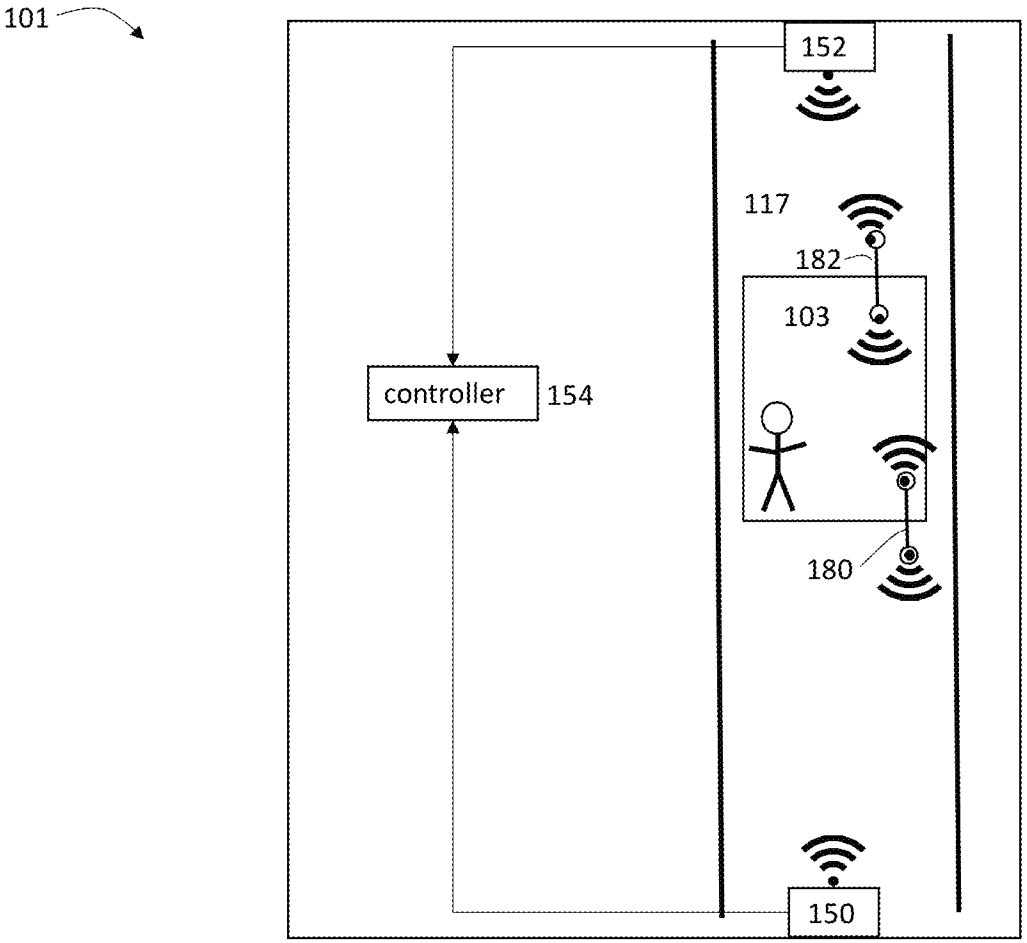
FIG. 6 depicts an elevator system with loading factor detection in an example embodiment.

FIG. 6 depicts an elevator system 101 with loading factor detection in another example embodiment. In the embodiment of FIG. 6, one or more antenna members may be used to aid in transmission of the signal from the transmitter 150 to the receiver 152. A first antenna member 180 may pass through the bottom of the elevator car 103, for example, via a cable to facilitate signal transmission through the bottom of the car. A second antenna member 182 may pass through the top of the elevator car 103, for example, via a cable, to facilitate signal transmission through the top of the elevator car. The elevator system 101 may include one or both of the antenna members 180 and 182.

Embodiments of this disclosure detect the loading factor in a conveyance system without identifying of the passenger(s) or other objects contributing to the loading factor. These techniques allow the identification of the number of passengers while keeping identity anonymous.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A conveyance system comprising:

a transmitter configured to generate a signal;

a receiver configured to receive the signal;

the transmitter and receiver located so that the signal passes through a passenger area of the conveyance system;

a controller configured to receive a non-zero signal strength of the signal received at the receiver;

the controller configured to determine a loading factor in the passenger area in response to the signal received at the receiver;

wherein the controller is configured to determine the loading factor in the passenger area in response to signal loss of the signal from the transmitter to the receiver;

wherein the passenger area comprises a moving portion of the conveyance system.

2. The conveyance system of claim 1 wherein the controller is configured to determine the loading factor in the passenger area in response to the signal strength of the signal received at the receiver.

3. The conveyance system of claim 2 wherein the controller stores a correlation of a loading factor in the passenger area to the signal strength of the signal received at the receiver.

4. The conveyance system of claim 1 wherein the controller stores a correlation of a loading factor in the passenger area to signal loss of the signal from the transmitter to the receiver.

5. The conveyance system of claim 1 wherein the conveyance system comprises an elevator system and the passenger area comprises an elevator car.

6. The conveyance system of claim 1 wherein the loading factor corresponds to one or more of passengers, cargo, luggage and pets in the passenger area.

7. A method of operating a conveyance system, the method comprising:

transmitting a signal through a passenger area of the conveyance system;

receiving a non-zero signal strength of the signal after passing through the passenger area of the conveyance system;

determining a loading factor in the passenger area in response to the signal after passing through the passenger area of the conveyance system;

wherein the determining is in response to signal loss of the signal after passing through the passenger area of the conveyance system;

wherein the passenger area comprises a moving portion of the conveyance system.

8. The method of claim 7 wherein the determining is in response to the signal strength of the signal after passing through the passenger area of the conveyance system.

9. The method of claim 8 further comprising correlating of a loading factor in the passenger area to signal strength of the signal after passing through the passenger area of the conveyance system.

10. The method of claim 7 further comprising correlating a loading factor in the passenger area to signal loss of the signal after passing through the passenger area of the conveyance system.

11. The method of claim 7 wherein the conveyance system comprises an elevator system and the passenger area comprises an elevator car.

12. The method of claim 7 wherein the loading factor corresponds to one or more of passengers, cargo, luggage and pets in the passenger area.

* * * * *